US006396524B1

(12) United States Patent
Cooper et al.

(10) Patent No.: US 6,396,524 B1
(45) Date of Patent: May 28, 2002

(54) SKEW ADJUSTMENT FOR OPTICAL WRITER IN A DOCUMENT PRINTER/COPIER

(75) Inventors: Allison S. Cooper, Webster; Robert A. Bovenzi, Rochester; Donald C. Buch, Penfield; Robert M. Peffer, Rochester; Paul H. Tam, Rochester; Jeffrey R. Ulreich, Rochester, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/574,057

(22) Filed: May 18, 2000

(51) Int. Cl.[7] ..... G03G 15/00

(52) U.S. Cl. ..... 347/138; 347/152; 399/110; 399/126

(58) Field of Search ..... 347/138, 152, 347/245, 257, 263, 242, 116, 130; 399/117, 118, 126, 110

(56) References Cited

U.S. PATENT DOCUMENTS 4,875,153 A * 10/1989 Hons ..... 347/138 X
5,155,506 A * 10/1992 Yamaguchi ..... 347/138
5,294,943 A * 3/1994 Blanding et al. ..... 347/257
5,374,993 A * 12/1994 Diehl et al. ..... 347/138
6,075,965 A 6/2000 Tombs et al. ..... 399/308

FOREIGN PATENT DOCUMENTS

JP 6-8508 * 1/1994
JP 7-52452 * 2/1995

OTHER PUBLICATIONS

U.S. Patent Application Serial No. 09/474,352, filed Dec. 29, 1999, in the names of Donald C. Buch et al, entitled Apparatus for Positioning Work Stations in a Document Printer/Copier.

U.S. Patent Application Serial No. 09/574,054, filed May 18, 2000, in the names of Donald C. Buch et al, entitled Pin Mount for Optical Writer/Image–Recording Element in a Document Printer/Copier.

* cited by examiner

*Primary Examiner*—Joan Pendegrass

(57) ABSTRACT

An electrophotographic printer/copier comprises a photoconductive drum assembly and an optical writer for projecting a rectilinear line of image information onto the drum's photoconductive surface. Both subsystems share the same pair of mechanical fiducials for precisely positioning these subsystems in the printer frame. According to the invention, the optical writer is movably mounted on the fiducials to adjust the skew of an image line projected onto the drum.

13 Claims, 7 Drawing Sheets

SKEW ADJUSTMENT FOR OPTICAL WRITER IN A DOCUMENT PRINTER/COPIER

CROSS-REFERENCE TO RELATED APPLICATIONS

Reference is made to the commonly assigned U.S. patent application Ser. No. 09/574,054, filed concurrently herewith and entitled "PIN MOUNT FOR OPTICAL WRITER/IMAGE-RECORDING ELEMENT IN A DOCUMENT PRINTER/COPIER."

FIELD OF THE INVENTION

This invention relates to the field of document printing/copying. More particularly, it relates to improvements in apparatus for precisely positioning an electro-optical printhead or "optical writer," e.g. a linear array of light-emitting diodes, relative to a reusable image-recording drum in a document printer/copier, that is, an electrophotographic printer and/or copier, so that a line of picture elements (pixels) can be imaged on the drum surface at a desired image location.

BACKGROUND OF THE INVENTION

The above-referenced U.S. application Ser. No. 09/574,054 discloses an electrophotographic document printer/copier comprising apparatus for positioning a solid state optical writer, such as a linear array of selectively energizable light-emitting diodes, relative to the photoconductive surface of an image-recording drum. In the document printer disclosed, both the optical writer and photoconductive drum assembly share a pair of mechanical fiducials, in this case dowel pins, to locate these subsystems in the printer frame. The ultimate position of the optical writer is determined by the engagement between the respective outer surfaces of the two dowel pins and a pair of V-notched blocks carried by opposite ends of the writer frame. In this printer, tight tolerances must be adhered to in order to achieve sharp focus of the image pixels projected by the writer onto the photoconductive drum surface, as well as to assure that the projected line of pixels is not skewed with respect to a desired image line on the drum surface. Such high tolerances are especially necessary in the case the printer comprises one of a plurality of printer modules used in a multicolor printer to produce three or four color separation images that are sequentially transferred to a single receiver sheet in perfect registration with each other. In a multicolor printer, it will be appreciated that each of the optical writers of the different print is modules must be precisely located relative to the imaging drum to ultimately achieve the requisite registration of color images.

While the apparatus disclosed in the above-noted application is capable of meeting the optical focus requirements required for sharp imagery, it does not lend itself to skew adjustment. Owing to the engagement between the V-notched blocks of the optical writer frame and the outer, lateral surface of the dowel pins, any lateral movement of one end of the writer to correct for a skewed image line is prevented. Thus, only through the use of shims and the like inserted between a V-notched block of the writer and the dowel pin can skew adjustment be achieved. While this scheme may suffice for monochrome printers, a finer and continuous adjustment scheme is required to achieve sharp images in a multicolor printer.

SUMMARY OF THE INVENTION

In view of the foregoing discussion, an object of this invention is to provide improved skew adjustment apparatus for controlling the position of an image line on a recording element used in a printing apparatus of the type described.

The apparatus of the present invention is useful in an electrophotographic printer/copier of the type comprising: (a) a frame; (b) a drum assembly including a rotatably mounted drum having a photosensitive outer layer upon which a plurality of work stations operate to produce an image; (c) an optical writer for projecting a rectilinear line of image information onto the drum's photoconductive surface as the drum rotates; and (d) a pair of mechanical fiducial mounteds on the frame, each fiducial being engaged by both the drum assembly and the optical writer to locate such subsystems on the frame. According to the invention, apparatus is provided for (a) pivotally mounting a first end of the optical writer on one of the mechanical fiducials for pivotal movement thereabout, (b) slidably mounting a second end of the optical writer for sliding movement atop the other mechanical fiducial, whereby the skew of an image line projected onto the drum surface by the optical writer is readily adjustable, and (c) selectively clamping the second end of the optical writer at a desired location on the second fiducial. Preferably, a micrometer-like mechanism is used to finely control the sliding movement of the second end of the writer atop the second fiducial.

As a result of the invention, the aforenoted disadvantages of using shims and the like to make skew adjustments in printers of the type described are avoided, and any skewing of the image line projected by the optical writer can be adjusted "on the fly" while the printer is in operation.

The invention and its technical advantageous effects will be better appreciated from the ensuing detailed description of a preferred embodiment, reference being made to the accompanying drawings in which like reference characters denote like or functionally similar parts.

DETAILED DESCRIPTION OF THE INVENTION

Figure 1:
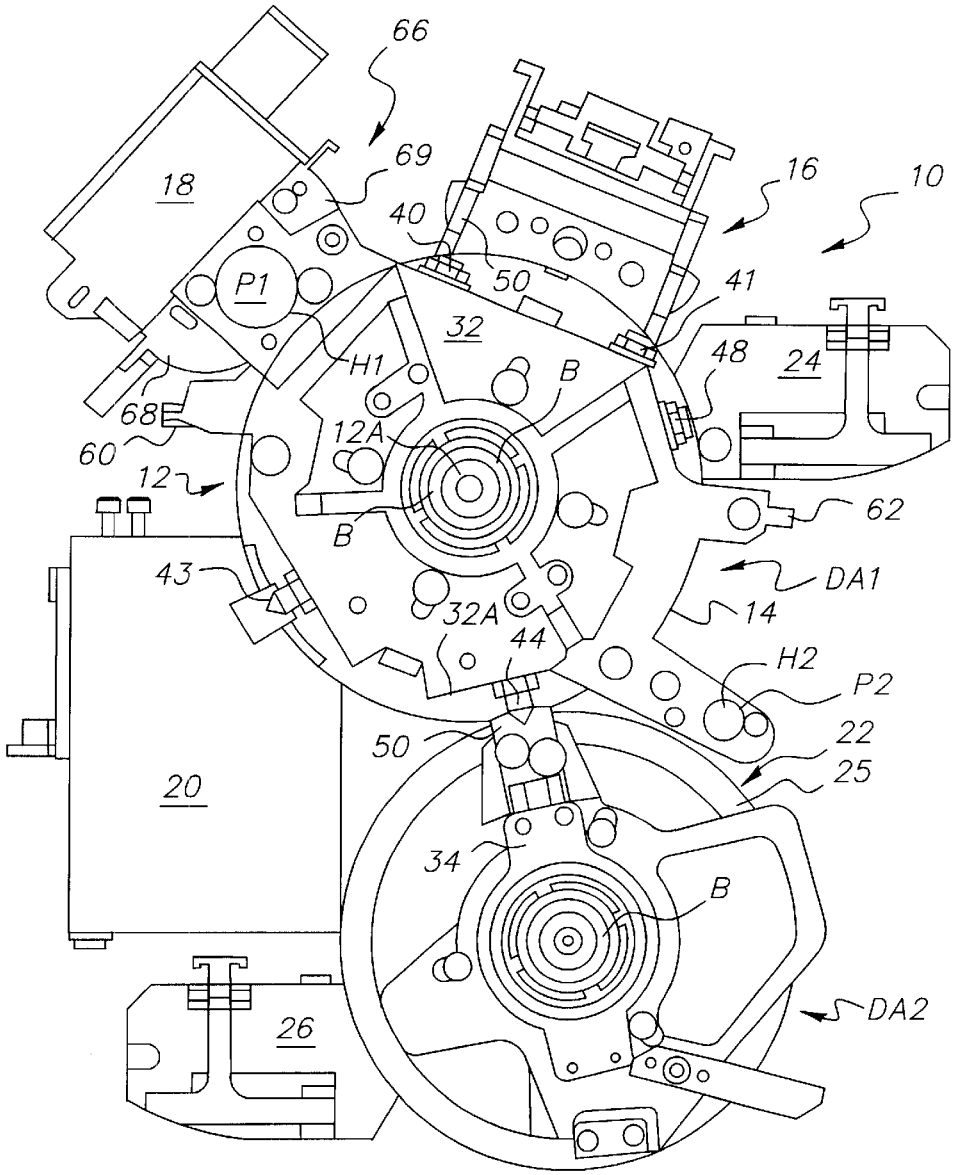
FIG. 1 is end elevation of an electrophotographic printer embodying the present invention.

Referring now to the drawings, FIG. 1 shows an electrophotographic printer 10 embodying the present invention. As shown, printer 10 comprises a drum assembly DA1 that includes an image-recording drum 12 having a photoconductive outer surface 14 on which toner images are formed in a conventional manner. The printer also comprises a second drum assembly DA2 having an intermediate image-transfer drum 22 with an adhesive (non-stick) surface 25 to which toner images formed on the photoconductive outer surface of image-recording drum 12 are transferred prior to being retransferred to a receiver sheet (not shown). Briefly, toner images are formed on the photoconductive surface of drum 12 by rotating the drum in a counter-clockwise direction (as viewed in FIG. 1) past a series of image processing stations that sequentially operate on a desired portion of the drum's photoconductive outer surface to produce a visible image. These image processing stations include a corona charging station 16 for uniformly charging the photoconductive surface 14 with electrostatic charges, a solid-state print head or optical writer 18 for imagewise exposing the charged photoconductive surface, line-by-line, to actinic radiation, thereby selectively dissipating the uniform charge and leaving behind a latent electrostatic charge image, and a toning station 20 for developing the charge image with pigmented electroscopic toner particles. The toner image thus formed is then transferred to the outer surface 25 of the image-transfer drum 22, and residual toner on drum 12 is removed by a cleaning station 24. Upon re-transferring the toner image on the intermediate transfer drum 22 to an image-receiver sheet, the surface of drum 22 is cleaned by a second cleaning station 26. Preferably, each processing station, with the exception of the optical writer, as explained below, is mounted for slight movement (e.g. about 5 to 7 mm.) towards and away from its respective operative position adjacent drum surface (shown in FIG. 1) to provide adequate clearance for installation and replacement of the drum assemblies and/or the processing stations. During such installation/replacement, the drum assemblies/processing stations are moved substantially parallel to drum's respective axis of rotation, through an opening 28 in the front mechanism plate FP of the machine frame F (shown best in FIG. 2).

Figure 2:
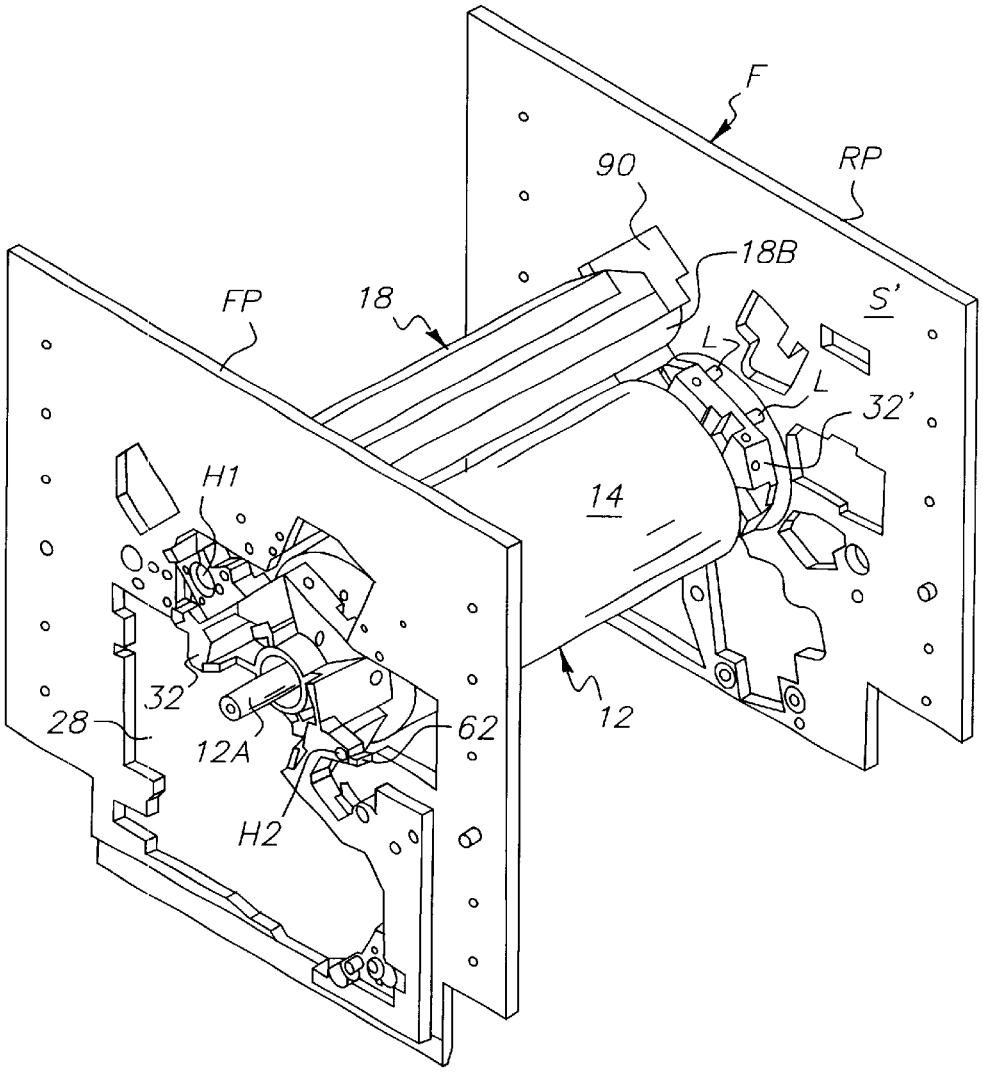
FIG. 2 is a perspective view of a portion of the FIG. 1 apparatus.

As shown in FIG. 2, the optical writer 18 spans the entire width of the image-recording drum 12. The optical writer comprises a linear array of light-emitting diodes (LED's) that are selectively energizable to project onto the photoconductive surface 14 of the rotating drum 12 a series of adjacent rectilinear lines of image information, each line comprising a multitude of picture elements (pixels) corresponding in number to the number of LED's in the linear array. Nominally, each line of image information is precisely parallel to the drum's axis of rotation. However, it may be appreciated that the printer shown in FIG. 1 may comprise one of several identical print modules in a full color electrophotographic printer. In such case, each print module will produce a different color separation image (e.g., cyan, magenta, yellow and black) that will be transferred in perfect registration to a receiver sheet. To assure that each of the color-separated toner images can be perfectly registered with the other toner images, it is necessary to provide a means for adjusting the position of each optical writer within its associated module. The present invention addresses this task.

Figure 3A:
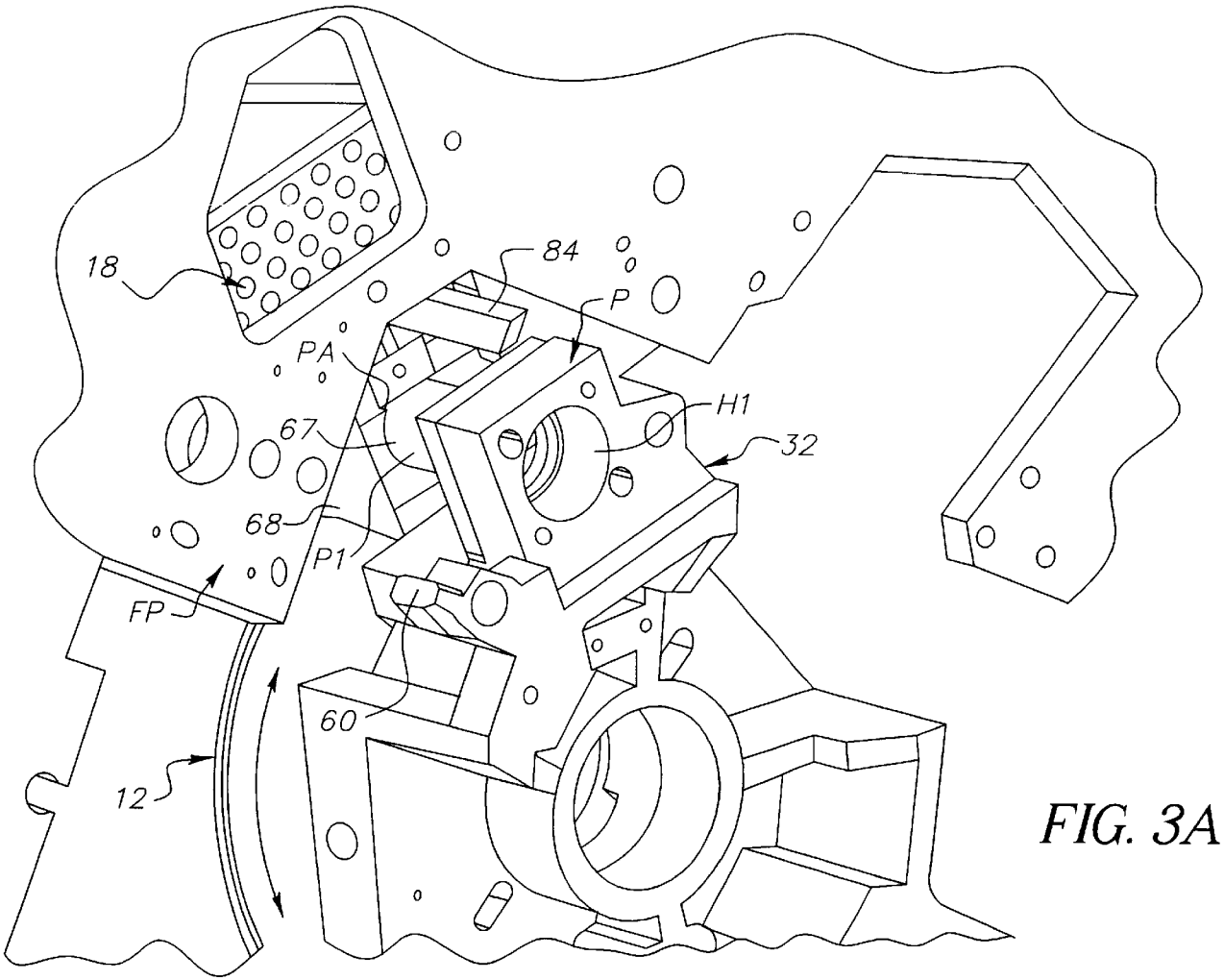
FIGS. 3A and 3B are enlarged perspective views of portions of the electrophotographic printer shown in FIG. 1.
Figure 3B:
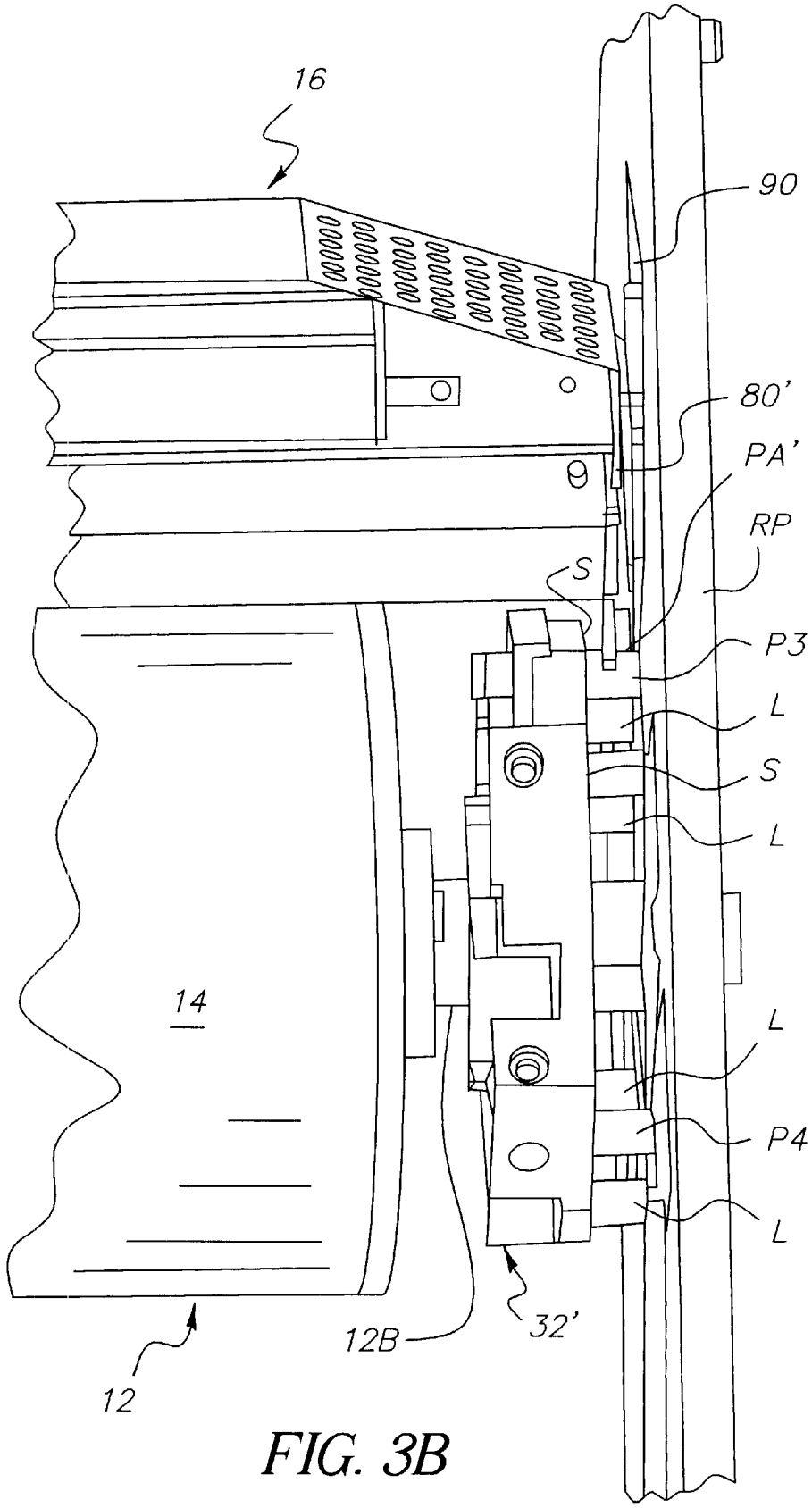
Figure 4:
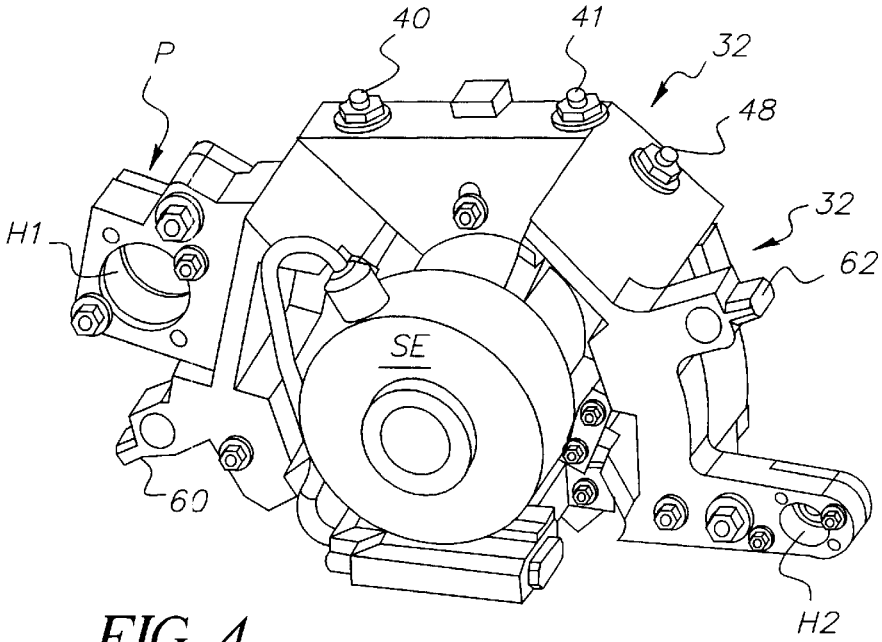
FIGS. 4 and 5 are perspective views of drum-support members.
Figure 5:
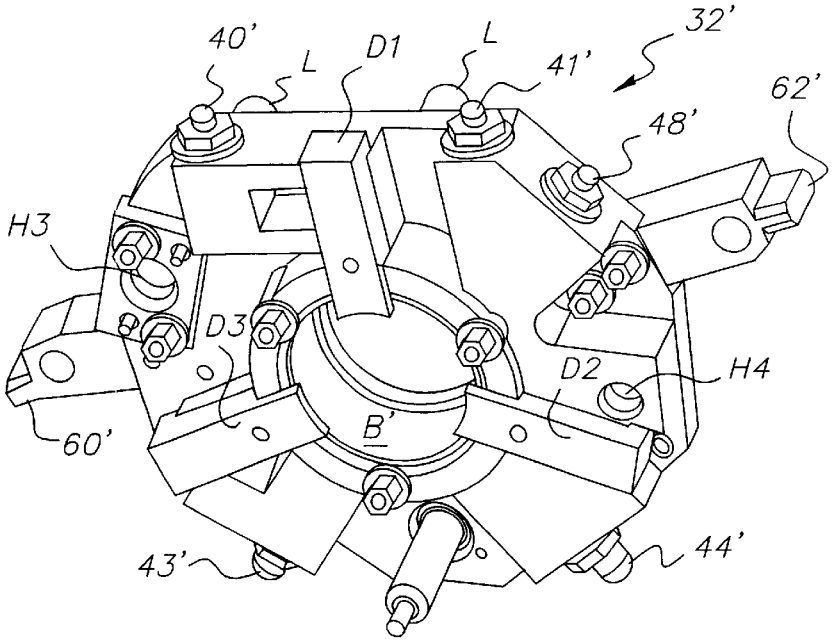

Referring additionally to FIGS. 3A, 3B 4 and 5, the photoconductive drum assembly DA-1 comprises, in addition to photoconductive drum 12, a pair of a pair of drum-support members 32,32'. These drum-support members are better described in U.S. patent application No. 09/474,352, filed on Dec. 29, 1999, the disclosure of which is hereby incorporated herein by reference. Briefly, members 32,32' serve to precisely and repeatedly positioning the various image processing and other work stations of the printer relative to the outer surfaces of the image-recording drum 12 to enable, for example, removal, servicing and replacement of the individual work stations and/or drum without altering a desired positional relationship between the work stations and the drum. Each drum-support member 32,32' has a centrally located bearing B or the like for rotatably supporting a drum axle (i.e., one of the drum axels 12A and 12B. The drum-support members, in turn, are supported in a predetermined position within the printer frame F, on a plurality of dowel pins P1–P4 mounted on the front and rear frame plates FP,RP, respectively, of the printer frame F. Drum-support members 32,32' are provided with a plurality of rounded reference surface features 40, 41, 43, 44, 48; and 40', 41', 43', 44' 48', respectively, which cooperate with complimentary reference surface features (e.g. V-notched blocks) carried by the respective processing stations to precisely position the work stations relative to the outer surface of the drum. Thus, as the work stations are moved radially inward from their respective stand-by or loading positions toward the drum's axis of rotation, i.e., toward their respective operative positions, as shown in FIG.1, the reference surface features of the work stations move into contact with and engage the reference surface features on the drum-support members to locate each work station in a desired position relative to the drum surface FIGS. 4 and 5 are enlarged perspective front views of the front and rear drum-support members 32 and 32', respectively. Front member 32 supports a shaft encoder SE through which the rotational speed of drum 12 is controlled. A plurality of clamps D1–D3 on each drum-support member serves to retain the bearings B, B' used to rotatably support the two drum axles. Ears 60, 62 carried by the front member 32, and ears 60', 62' carried by rear member 32' cooperate with a pair of spaced, parallel guide channels (not shown) positioned between the front and rear frame plates of the printer frame for the purpose of slidably guiding the drum assembly to its operating position where it is supported by the afore-mentioned dowel pins P1–P4 on the front and rear frame plates. Pins P1–P4 are adapted to engage holes H1–H4, respectively, formed in the front and rear drum-support members to precisely position the drum assembly within the printer frame.

Figure 6:
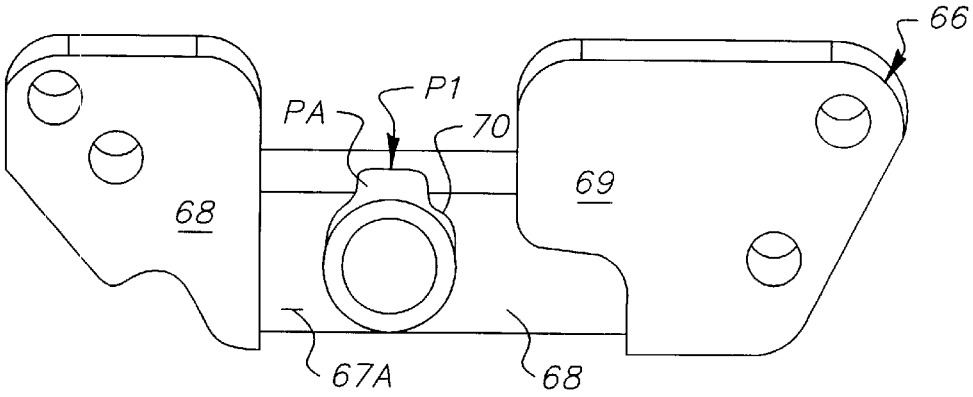
FIG. 6 is an enlarged front perspective view of a printer frame piece supporting a dowel pin.
Figure 7:
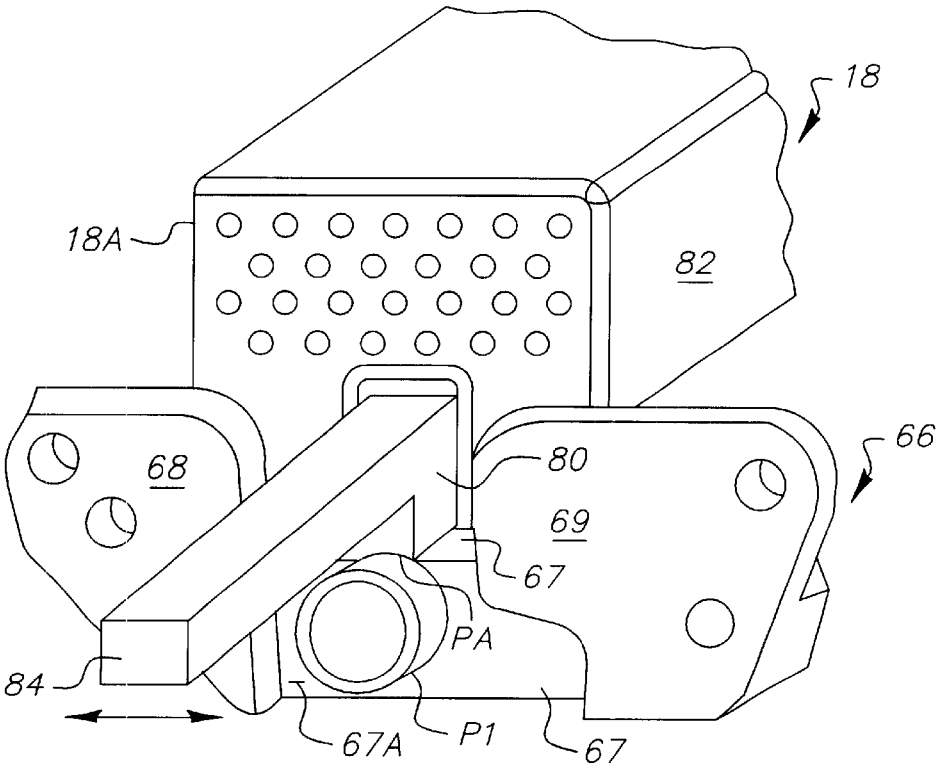
FIG. 7 is a front perspective view of a portion of an optical writer supported by the dowel pin shown in FIG. 6.

As noted in the afore-mentioned U.S. patent application Ser. No. 09/574,054, filed concurrently herewith, dowel pins P1 and P3 function as mechanical fiducials for positioning both the drum assembly DA1 within the printer frame, and the optical writer 18 relative to the photoconductive surface 14 of drum 12. Referring to FIG. 6, dowel pin P1 is shown to be supported by a frame piece 66 that is adapted to be bolted to the rear surface of the front frame plate FP so as to become part of the front frame plate. Preferably, pin P1 is made of hardened steel and has a diameter of about 20 mm. Frame piece 66 also made of hardened steel and comprises a flat bar portion 67 extending between a pair of tabs 68 and 69. Bar portion 67 has a hole 70 formed therein, and dowel pin P1 is press fit therein. The indented space between tabs 68 and 69 is shaped to receive that portion P of drum-support member 32 in which hole H1 is formed. See FIG. 4. Thus, as the drum assembly is loaded into the printer frame through the opening 28 formed in the front frame plate FP, hole H1 will engage and slide upon pin P1. Inward movement of the drum assembly will eventually be arrested as the rear surface of drum-support portion P engages the front surface 67A of bar portion 67 of the frame piece 66. When fully seated on pin P1, that portion of the outer surface of pin P1 underlying the surface 67A acts as a fiducial or reference point for locating the drum assembly 12. Preferably, the hole 70 formed in bar portion 67 does not pass entirely through the bar portion 67, and the top portion of the bar portion is milled away so that an outer surface area PA of the dowel pin P1 will be exposed. As shown in FIG. 7, it is this portion PA of pin P1 that is used to support and act as a fiducial for the front end 18A optical writer 18. Owing to the close spacing between the two points on the surface of pin P1 that support the optical writer and drum assembly DA1, both subsystems of the printer module(s), may be considered to be positioned within the printer frame by the same mechanical fiducial or reference point. By this arrangement, a tolerance-stacking problem is mitigated, as discussed in the cross-referenced patent application above.

Referring to FIGS. 2 and 3B, the rear drum-support member 32' of drum assembly DA1 is supported on dowel pins P3 and P4 carried by the rear frame plate RP of the printer frame. Pins P3 and P4 engage holes H3 and H4, respectively, formed in member 32'. When the front drum-support member 32 of the drum assembly is seated on pins P1 and P2 as described above, the rear drum-support member 32' will have slid on pins P3 and P4 until the rear surface S of member 32' is spaced (by about 6 mm) from the front surface S' of the rear frame plate RP and will be spaced therefrom by a plurality of legs L. As a result, a space PA' is provided on the upper surface of pin P3 for receiving and supporting a V-block 80' mounted on the rearward end 18B of the optical writer. Again, owing to the close spacing between the points at which pin P3 supports both the drum-support member 32' and V-block 80', virtually the same portion of the pin operates as the fiducial for both the drum assembly and the optical writer, thereby eliminating the tolerance stacking problem discussed above. As shown, the width of pin space PA' is about 7 mm.

Figure 8:
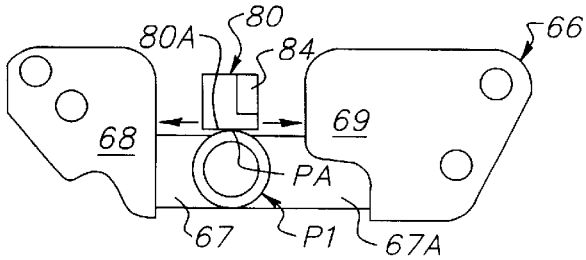
FIG. 8 is an end view of a portion of the apparatus shown in FIG. 7.
Figure 9:
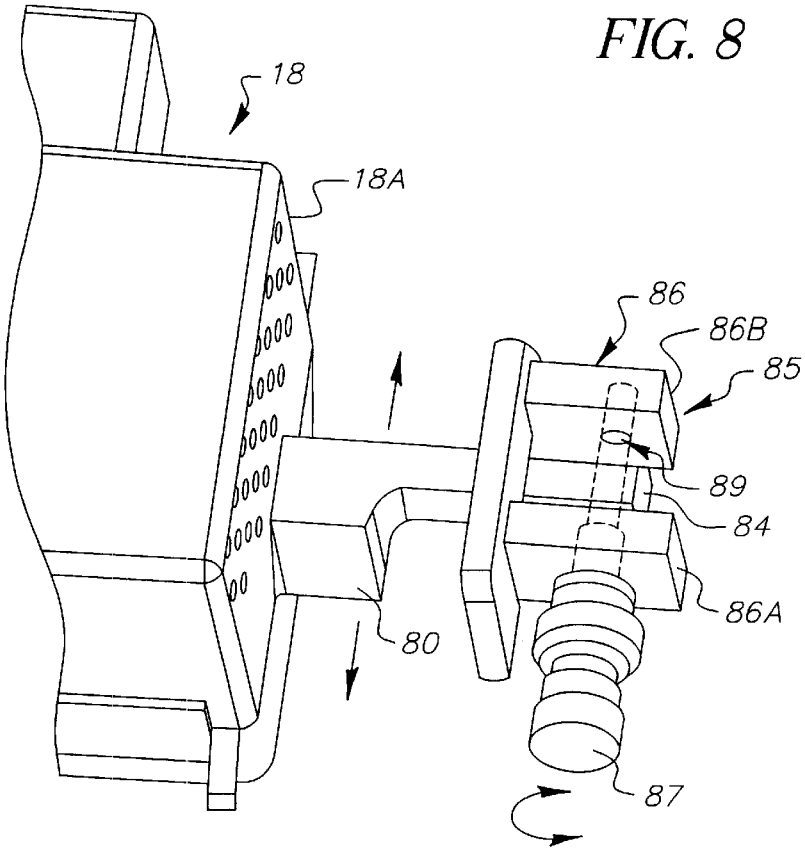
FIG. 9 is a top perspective view showing a portion of the skew-adjusting apparatus of the invention.
Figure 10:
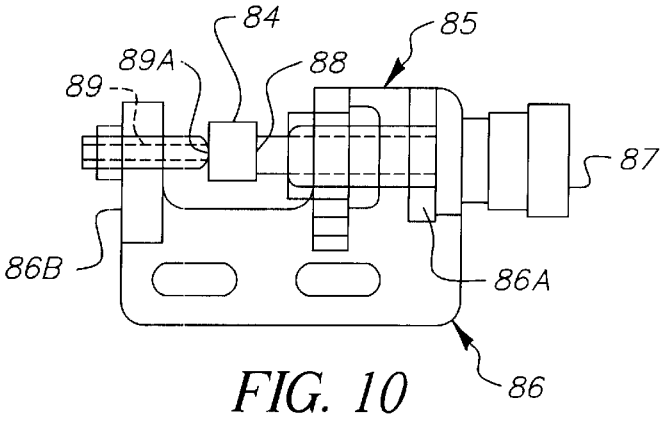
FIG. 10 is a side elevation of a portion of the apparatus shown in FIG. 9.

In accordance with the invention, the front end 18A of the optical writer is slidably mounted on the outermost surface area PA of pin P1, while the rearward end 18B is supported for pivotal movement on surface area PA' of pin P3. By this arrangement, the skew of an image line projected onto the drum surface by the optical writer is adjustable. Referring to FIGS. 7–9, a planar surface 80A of a mounting block 80 extending from the optical writer frame 82 is urged into contact with the rounded outer surface area PA of pin P1. Thus, while the surface PA still acts as a fiducial to control the spacing of the writer from the drum surface and, hence, the image focus, it does not constrain the writer from movement in a direction parallel to a tangent to the drum surface, as indicated by the arrows in FIG. 8. In other words, block 80 is free to slide atop surface PA in the direction of the arrows and, in doing so, the amount of image skew is adjustable. Preferably, mounting block 80 is provided with a skew adjustment arm 84 that extends axially outward from block 80. As shown in FIGS. 9 and 10, a micrometer-type mechanism 85, mounted on the front frame plate FP operates on the skew-adjustment arm to control its position. Such mechanism comprises a U-shaped bracket 86 that is adapted to be mounted on frame plate FP, a fine adjustment knob 87 that is rotatable to advance a cylinder 88 linearly through one leg 86A of the bracket 86, and an opposing threaded member 89 passing through the other leg 86B of the bracket. As shown, skew adjustment arm 84 is positioned to be advanced in one direction by the free end of cylinder 88 as knob 87 is rotated. As the adjustment arm is mover mounting block 80 slides on surface PA and the v-notched block 80' pivots on pin surface PA'. In this manner the skew angle of a projected image line is adjusted so as to achieve a desired registration with other image lines. Upon moving the optical writer to a desired location, member 89 is threaded into bracket arm 86B until one end 89A of member 89 contacts and thereby captures the adjustment arm 84 together with the free end of cylinder member 88. A nut 90 is then tightened on the opposite end of member 89, thereby locking the skew adjustment arm in place.

From the foregoing, it will be appreciated that a technically advantageous method and apparatus have been provided for mounting a solid-state optical writer in a document printer/copier. By using the same mechanical fiducials to locate both the photoconductive drum assembly and the optical writer, a stacking of mechanical tolerances is avoided. Further, by using a different portion of the fiducials to register each subsystem, either subsystem can be removed from the printer without disturbing the other. Further, by mounting the optical writer for sliding movement on one fiducial and pivotal movement on the other, an easy adjustment for image line skew can be effected. Such adjustment can be made "on the fly as the printer is operating, i.e., there is no need to shut down the printer to effect skew adjustment. The adjustment can also be made substantially by providing a motorized control and drive to rotate the micrometer-type mechanism in response to sensing of recorded indicia.

The invention has been described with reference to an electrophotographic printer/copier apparatus. An example of an electrophotographic printer/copier apparatus is described in U.S. patent application Ser. No. 08/900,696, filed in the name of Tombs et al, the contents of which are incorporated herein by reference. The apparatus and method of the invention may be used to locate and adjust the skew of the writer or other process or work station, such as a charging station, development station, cleaning station which typically operates upon a photoconductive surface during an electrophotographic process. The invention may also be used for positioning a process or work station about other toner image bearing or recording surfaces such as an intermediate transfer member. The invention has been described with reference to positioning a process or work station about a drum. However, the invention also contemplates that the apparatus and method thereof may also be used to accurately position a process station in any electrostatographic apparatus about a toner image bearing or recording surface including surfaces formed as a web wherein the web is supported by a roller. The roller would be journaled for rotation and accurately located relative to the frame by having a first surface connected thereto engaging one portion of the pin and a process station operating on a toner image bearing or recording surface and having a second surface connected to the process station engaging a second portion of the pin to accurately locate the process station relative to the toner image bearing or recording surface. The apparatus and method of the invention may also be used in electrographic recording apparatus wherein stylus writers or other types of writers or other process stations are used to record or transfer electrostatic images on a surface and are required to be accurately positioned relative to the toner image bearing or recording surface.

While the invention has been described with reference to a particularly preferred embodiment, it will be appreciated that variations can be made without departing from the spirit of the invention, and such variations are intended to fall within the scope of the appended claims.

PARTS LIST

10—electrophotographic printer
12—image-recording drum
14—photoconductive surface
16—corona charging station
18—print head

20—development station
22—image-transfer drum
24—cleaning station
26—cleaning station
28—opening in front frame plate
32,32'—drum support members for drum 12
34—drum support member for drum 22
36—frame piece
37—bar portion of frame piece
40, 40', 41, 41', 43, 43', 44, 44', 48, 48'—fiducials on drum support
members for positioning printer work stations
50—V-grooved block for locating image-transfer drum
60,62—ears for guiding drum assembly
66—frame piece
67, 68, 69—portions of frame piece
67A—front surface of member 67
80,80'—V-block fiducials for positioning optical writer
80A—planar surface on block 80
82—optical writer frame
84—skew adjustment arm
85—micrometer mechnism
86—U-shaped bracket
86A, 86—bracket legs
87—adjustment knob
88—cylinder
89—threaded member
89A—end of threaded member
90—nut
DA1—drum assembly 1
DA2—drum assembly 2
A—drum axles
B—bearings
F—printer frame
L—legs on rear drum-support member 32'
P—portion of front drum-support member 32
S—rear surface of drum-support member 32'
S'—front surface of rear frame plate
FP—front plate of printer frame
RP—rear plate of printer frame
SE—shaft encoder
D1–D3—bearing-retainers
P1–P4—mounting pins
H1–H4—mounting holes
PA,PA'—fiducials for positioning optical writer

What is claimed:

1. An electrophotographic printer/copier comprising:

a frame;

a drum assembly including a rotatably mounted drum having a photosensitive outer layer upon which a plurality of work stations operate to produce an image;

an optical writer for projecting a rectilinear line of image information onto the drum's photoconductive surface as the drum rotates;

a pair of mechanical fiducials mounted on the frame, each fiducial being engaged by both the drum assembly and the optical writer to locate such assembly and the writer on the frame;

means for pivotally mounting a first end of the optical writer on one of the mechanical fiducials for pivotal movement thereabout;

means for slidably mounting a second end of the optical writer for sliding movement atop the other mechanical fiducial, whereby the skew of an image line projected onto the drum surface by the optical writer is readily adjustable; and means for slidably advancing the second end of the optical writer atop said other mechanical fiducial and for clamping said second end at a desired location on the second fiducial.

2. An electrophotographic printer/copier of the type comprising:

a frame;

a drum assembly including a rotatably mounted drum having a photoconductive outer layer upon which a plurality of work stations operate to produce an image;

an optical writer for projecting a rectilinear line of image information onto the drum's photoconductive surface;

a pair of mechanical fiducials mounted on the frame and engageable with opposite ends of both the drum assembly and the optical writer to locate such assembly and the writer on the frame;

a pivotal mount for mounting the optical writer on one of said mechanical fiducials for pivotal movement thereabout, whereby the skew of an image line projected onto the drum surface by the optical writer is adjustable; and an adjustment device for controlling the pivotal position of said optical writer on said one mechanical fiducial.

3. The printer/copier as defined by claim 2 wherein said pivotal mount comprises a block having a V-shaped notch, said block being operatively connected to said optical writer and a pin mounted on said frame and positioned within said notch.

4. The printer/copier as defined by claim 2 wherein said adjustment device comprises a micrometer-like mechanism for pivoting one end of said optical writer on said mechanical fiducial.

5. An electrophotographic printer/copier comprising:

(a) a frame;

(b) a drum assembly comprising (i) a drum having a photoconductive outer layer upon which a plurality of work stations are intended to operate to produce an image; and (ii) a pair of drum-support members for rotatably supporting said drum for rotation about a drum axis;

(c) an optical writer for projecting image information onto said photosensitive surface;

(d) a pair of mechanical fiducials mounted on said frame for locating both said drum assembly and said optical writer on said frame;

(e) means for urging respective portions of said optical writer and said drum assembly into contact with said mechanical fiducials; and (f) means for movably mounting said optical writer on said fiducials to adjust the location at which said optical writer projects an image on said drum.

6. The printer/copier as defined by claim 5 wherein said frame comprises a pair of spaced frame plates, and wherein said mechanical fiducials comprise a pair of mounting pins, one of said pins extending outwardly from each of said frame plates.

7. The printer/copier as defined by claim 2 wherein said mounting pins engage holes in said drum-support members whereby said drum assembly is supported by said pins at first locations along the respective outer surfaces of said pins, and wherein said optical writer comprises a frame having portions that contact said respective outer surfaces at second locations closely spaced from said first location.

8. The printer/copier as defined by claim 6 wherein an exposed portion of the outer surface of at least one of said pins is located within the plane of one of said frame plates.

9. A method for positioning an optical writer relative to a photosensitive surface of an image-recording drum assembly on a frame of an electrophotographic printer/copier, said method comprising the steps of:

(a) providing a pair of mechanical fiducials on said frame;

(b) mounting said image-recording drum assembly on respective first portions of each of said mechanical fiducials;

(c) pivotally mounting a first end of said optical writer on one of said mechanical fiducials at a location closely spaced to one of said first portions; and (d) slidably mounting a second end of said optical writer on the other of said mechanical fiducials at a location closely spaced to the other of said first portions; and (e) controlling the sliding position of said second end of said optical writer on said other mechanical fiducial.

10. An electrostatographic printer/copier comprising:

a frame;

a drum assembly including a rotatably mounted drum or roller supporting an image supporting surface upon which one or more work stations operate to produce an image;

a work station for operating on the surface, and a mechanical fiducial mounted on the frame and engageable with one end of each of the drum assembly and the work station to locate the work station relative to the surface frame; and a sliding mount having an adjustment device for controlling the pivotal position of said work station on said mechanical fiducial.

11. The printer/copier of claim 10 wherein said mechanical fiducial is a pin.

12. A method for positioning a work station relative to an image supporting surface supported by a drum or roller in an image reproduction apparatus, said method comprising the steps of:

(a) providing a mechanical fiducial on a frame of the apparatus;

(b) mounting said drum or roller on a first portion of said mechanical fiducial;

(c) mounting an end of said work station on said mechanical fiducial at a location closely spaced to said first portion; and (d) slidably adjusting the position of said end of said work station on said mechanical fiducial to adjust the skew of the work station relative to the surface.

13. The method of claim 12 wherein said mechanical fiducial is a pin.

* * * * *